US009155920B1

(12) United States Patent
Billen

(10) Patent No.: US 9,155,920 B1
(45) Date of Patent: Oct. 13, 2015

(54) PASS-THROUGH DEVICE FOR ENVIRONMENTAL PROTECTION SUIT

(71) Applicant: Flight Suits, El Cajon, CA (US)

(72) Inventor: Marc Christian Billen, Lakeside, CA (US)

(73) Assignee: Flight Suits, El Cajon, CA (US)

( * ) Notice: Subject to any disclaimer, the term of this patent is extended or adjusted under 35 U.S.C. 154(b) by 361 days.

(21) Appl. No.: 13/662,478

(22) Filed: Oct. 28, 2012

Related U.S. Application Data

(60) Provisional application No. 61/552,278, filed on Oct. 27, 2011.

(51) Int. Cl.
*A62B 17/00* (2006.01)

(52) U.S. Cl.
CPC ..... *A62B 17/00* (2013.01)

(58) Field of Classification Search
None
See application file for complete search history.

(56) References Cited

U.S. PATENT DOCUMENTS

| | | | | |
|---|---|---|---|---|
| 2,459,752 | A * | 1/1949 | Wilson et al. | 285/200 |
| 3,777,750 | A * | 12/1973 | Savornin | 128/201.29 |
| 6,076,571 | A * | 6/2000 | Burns et al. | 141/383 |
| 6,173,997 | B1 * | 1/2001 | Nordstrom et al. | 285/139.1 |
| 6,318,581 | B1 * | 11/2001 | Garton | 220/565 |
| 6,634,676 | B1 * | 10/2003 | Lampson et al. | 285/123.15 |
| 7,089,995 | B2 | 8/2006 | Koscheyev et al. | |
| 7,585,001 | B2 | 9/2009 | Rose | |
| 7,875,011 | B2 | 1/2011 | Harvie | |
| 2005/0062284 | A1 * | 3/2005 | Schreiner et al. | 285/139.1 |
| 2011/0095523 | A1 | 4/2011 | Rose | |

OTHER PUBLICATIONS

Kaufman, J.W., "Cooling Individuals Using Encapsulating Protective Clothing in a Hot Humid Environment", RTO HFM Symposium on "Blowing Hot and Cold: Protecting Against Climatic Extremes", Oct. 8-10, 2001, held in Dresden, Germany, published in RTO-MP-076, pp. 18-1 to 18-13.

Pimental, N.A., et al., "Effectiveness of a Prototype Microclimate Cooling System for Use with Chemical Protective Clothing", Navy Clothing and Textile Research Facility, Natick, MA, Technical Report No. NCTRF 180, Date of Report: Dec. 1990, 26 pages.

* cited by examiner

*Primary Examiner* — James Hewitt
(74) *Attorney, Agent, or Firm* — Eleanor Musick; Greer, Burns & Crain, Ltd.

(57) ABSTRACT

A pass-through device is provided with one or more sealed connection channels which permit fluid to pass through an environmental protection suit. The device includes an inner housing and an outer housing formed from a flexible PVC with one or more respective inner channels and outer channels configured in each, such that when the inner housing and outer housing are connected, the inner channels and outer channels are sealably connected at a central channel opening to provide sealed conduits through which a fluid or gas passes. The inner housing and outer housing may be connected via a plurality of peripheral retention screws on the inner housing which interface with a plurality of peripheral barrel nuts on the outer housing.

13 Claims, 7 Drawing Sheets

PASS-THROUGH DEVICE FOR ENVIRONMENTAL PROTECTION SUIT

RELATED APPLICATIONS

The present application claims the priority of U.S. provisional application No. 61/552,278, filed Oct. 27, 2011, which is incorporated herein by reference in its entirety.

FIELD OF THE INVENTION

This invention relates to a pass-through device for conducting fluids into and out of an environmental protection suit without impacting the suit's protective seal, and more specifically to a pass-through device which provides multiple sealed channels for flow of liquid or gas through an environmental protection suit.

BACKGROUND

Environmental protection suits are used to isolate a user from an external environment which may be hazardous or uncomfortable to a human. The environmental protection suit completely encloses a user within the suit and avoids exposure to the outside environment. The environmental protection suit may prevent exposure to an outside environment which may contain dangerous chemicals or radiation, biological contaminants, harsh environmental conditions (fire or smoke) or even uninhabitable environments (underwater, space).

The impermeable or semi-permeable garments that provide protection against hazardous environments can retain body heat that needs to be removed if the garment user is to adequately perform required tasks, especially when the user is physically active. Otherwise, trapped heat can lead to heat exhaustion or hyperthermia, a potentially dangerous condition that can severely degrade mission performance, cause injury and in extreme cases, death.

Flexible heat exchangers have proven to be one of the most effective methods of adding or extracting heat from the human body. In general, heating or cooling garments are exemplified by U.S. Pat. Nos. 3,451,812; 3,425,486; 3,419,702; 4,691,762; 4,718,429; and 4,998,415, which are incorporated herein by reference. Other types of systems for body heating and cooling are illustrated and described in U.S. Pat. Nos. 4,114,620 and 5,062,424 and Patent Publication No. 2011/0120624, each of which is incorporated herein by reference.

A liquid cooled garment ("LCG") normally consists of a fabric shell and a labyrinth of flexible tubing affixed in some fashion to the shell. A liquid is cooled using a chiller and circulated through the LCG by a pump to which the LCG is connected through external tubing and a manifold that distributes the liquid to the LCG's tubing. Liquid chillers can be as simple as a water/ice bath or as complicated as a vapor compression refrigeration device. Whichever device is used, it lowers the temperature of the liquid below the skin temperature of the user and mechanically re-circulates the liquid through the LCG.

In many situations, the integrity of the environmental protection suit is critical to the health and safety of the wearer—the suit must remain impermeable to the hazard from which the user is being protected. However, if an LCG is to be worn underneath the suit, connections must be provided to provide an unimpeded flow path from the chiller and pump outside of the suit and the LCG inside the suit without compromising the protective barrier provided by the suit. The pass-through device must provide a durable secure connection between the interior and exterior tubing while simultaneously preventing the hazardous substance or condition, e.g., gas, fluid, radiation, heat, etc., from entering the suit.

Prior art pass-through devices are typically formed from rigid plastic such as polyamides, e.g., NYLON®. Barbs formed at inlet and outlet fittings of the pass-through device are generally used to secure the tubing. This configuration produces a significant reduction in inner diameter of the channel at the hose barbs, which impairs the performance of the garments due to the reduced liquid flow (increased back pressure) at both the input and output ports. For example, for a fitting with an inner diameter of 0.070 in. (1.78 mm) and flexible tubing having an inner diameter of 0.096 in. (2.4 mm), the barbed fitting reduces the cross-sectional area of the supply/return tubing by ~10% to ~50% of the garment tubing.

In addition, incompatibility in durometer (hardness) between the rigid pass-through material and the flexible PVC tubing can produce a weaker joint, requiring secondary fixation such as cable ties or clamps. On the other hand, if the same fitting configuration were to be fabricated using PVC resin, it would require a thicker cross-section to achieve strengths similar to the current rigid polymer version. Additional drawbacks of such designs include the lack of conformability to the natural curvatures and movements of the human body, which can introduce strain on the tubing due to increased flexing near the pass-through connections; increased garment wear near the location of the pass-through, and possible discomfort for the user.

Accordingly, the need remains for a pass-through device that can be used for an environmental protection suit which provides an adequate seal and an improved flow for the cooling substance.

SUMMARY

Embodiments of the invention herein describe a pass-through device with a plurality of sealed connection channels which permit a cooling fluid to pass through an environmental protection suit without compromising the suit's integrity. The device includes an inner housing and an outer housing with one or more respective inner channels and outer channels configured in each, such that when the inner housing and outer housing are connected, the inner channels and outer channels are sealably connected at a central channel opening to provide sealed conduits through which a fluid or gas passes. The inner housing and outer housing may be connected via a plurality of peripheral retention screws on the inner housing which interface with a plurality of peripheral barrel nuts on the outer housing.

In one embodiment of the invention, a pass-through device comprises an inner housing with an inner channel, an outer housing with an outer channel, and a connection means which connects the inner housing with the outer housing and forms a sealed connection between the inner channel and the outer channel. The connection means comprise a plurality of peripherally-disposed retention screws on the inner housing which interface with a plurality of peripherally-disposed barrel nuts in the outer housing. The connection means may further comprise an inner flange disposed between the inner housing and the outer housing, and may be configured with openings to accept the peripherally-disposed retention screws. The connection means may further comprise an outer flange disposed on an outer surface of the outer housing, and may be configured with openings to accept the plurality of peripherally-disposed barrel nuts.

The inner channel and outer channel may extend from the inner housing and outer housing at approximately right angles.

In another aspect of the invention, a device is provided for conducting a fluid between an interior and an exterior of a sealed fabric enclosure having a pass-through opening, where the device includes an inner housing having an inner flange portion, a first inlet channel and a first outlet channel, each of the first inlet and first outlet channels having proximal ends that extend through a center of the inner flange portion; an outer housing having an outer flange portion with a second inlet channel and a second outlet channel, each of the second inlet and second outlet channels having proximal ends that extend through a center of the outer flange portion, wherein the center of the inner flange portion and the center of the outer flange portion correspond to the pass-through opening of the sealed fabric enclosure; and a plurality of fasteners inserted through matching openings formed in each of the inner flange portion, the outer flange portion and the seal fabric enclosure to form a sealed connection between the first and second inlet channels and the first and second outlet channels, respectively, wherein the inner housing and the outer housing are made from a flexible polyvinyl chloride (PVC) material.

In the preferred embodiment, the inner housing and the outer housing each comprise a metal plate molded into the flexible PVC material. The plurality of fasteners may be barrel nuts, where each barrel nut has a barrel portion and a stud portion, and where the barrel portions are embedded into the flexible PVC material of the inner housing during molding.

From this description, in conjunction with other items, the advantages of the said invention will become clear and apparent more so based upon the hereinafter descriptions and claims, which are supported by drawings with numbers relating to parts, wherein are described in the following sections containing the relating numbers.

BRIEF DESCRIPTION OF THE DRAWINGS

The accompanying drawings, which are incorporated in and constitute a part of the specification, illustrate embodiments of the invention and, together with the description, serve to explain the objects, advantages, and principles of the invention. In the drawings:

FIG. 7A is a perspective view, FIG. 7B is a cross-sectional view taken along line A-A of FIG. 7C, and FIG. 7C is an end view of the barrel nut.

DETAILED DESCRIPTION OF EXEMPLARY EMBODIMENTS

Figure 1A:
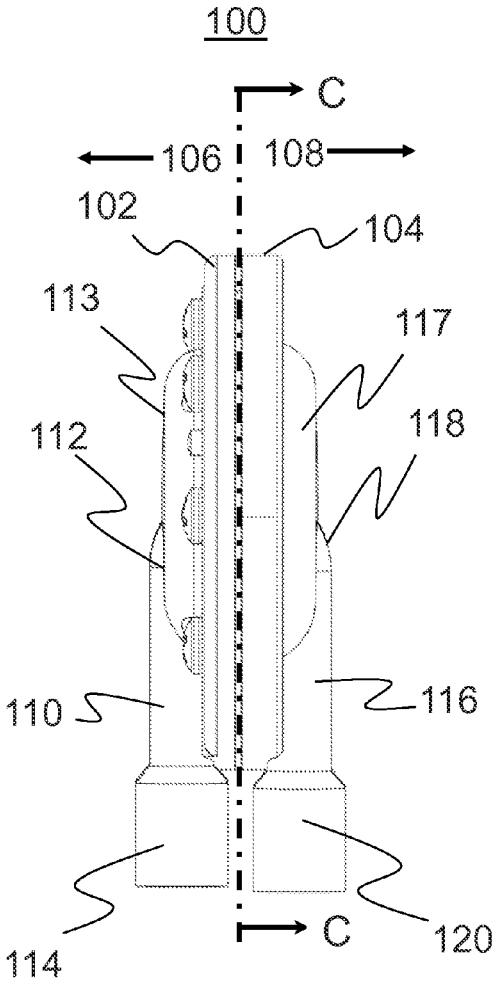
FIG. 1A is a side-view illustration of a pass-through device with an inner housing, an outer housing and respective inner channels and outer channels, according to one embodiment of the invention.

After reading this description it will become apparent to one skilled in the art how to implement the invention in various alternative embodiments and alternative applications. However all the various embodiments of the present invention will not be described herein. It is understood that the embodiments presented here are presented by way of an example only, and not limitation. As such, this detailed description of various alternative embodiments should not be construed to limit the scope or breadth of the present invention as set forth below.

Embodiments of the invention herein describe a pass-through device with a plurality of sealed connection channels which permit fluid or gas to pass through an environmental protection suit without compromising the integrity of the suit. The device includes an inner housing and an outer housing with one or more respective inner channels and outer channels configured in each, such that when the inner housing and outer housing are connected, the inner channels and outer channels are sealably connected at a central channel opening to provide sealed conduits through which a fluid passes. The inner housing and outer housing may be connected via a plurality of peripheral retention screws on the inner housing which interface with a plurality of peripheral barrel nuts on the outer housing.

The embodiments of the pass-through device described above may be implemented in many types of environmental protection suits, such as chemical and biological hazard suits, cold water dry suits, fire protection suits, and cooling suits. The pass-through may be implemented into a cooling suit where the pass-through is useful to prevent leakage of the fluid entering into the cooling suit rather than to prevent contaminants from entering the suit, although the pass-through device is beneficial for both uses. The pass-through device may be implemented in environmental protection suits which need to provide flexible connections due to the anticipated movement of the suit or the connecting tubes connected with the suit.

Each of the inner housing and outer housing include multiple integrated sealing features to prevent internal leaks along the channels and to prevent external contamination from compromising the integrity of the environmental protection suit once the pass-through device is mounted onto the suit. The construction allows the pass-through to be securely attached to the fabric of the suit.

As shown in FIG. 1A-FIG. 5, rigid structures for attaching the fastening means to the flexible PVC housings halves are provided by stainless steel inner and outer flanges 124 and 126. The inner and outer flanges, which have openings formed therethrough for insertion of fasteners are over-molded, i.e., embedded, into their corresponding housing halves during the molding process for forming the housings. It should be noted that while flanges 124 and 126 are illustrated in FIG. 3B as having an annular configuration with a single open center, this is intended to indicate the attachment order and is not intended to suggest that the flanges are necessarily annular. The fasteners, threaded studs 122 and guide pegs 125, are seated in the inner flange 124 prior to molding, so that the fasteners extend toward the center of the device. The studs 122 mate with barrel nuts 132 that are inserted through openings in the outer flange 126 and outer housing 104 to securely fasten the inner and outer housings together.

As a result of the over-molding process, annular ridges 129 (seen in FIG. 5) corresponding to the ends of channels 110 and 116 may be formed as a result of the PVC material oozing through openings 142 and 146 in the outer flange 126 and inner flange 124, respectively. Once assembled, these ridges can act to provide a effective seal between corresponding inflow and outflow channels of channels 110 and 116.

Now describing the elements of an embodiment of the pass-through device in more detail, a side-view illustration of the pass-through device is depicted in FIG. 1A. The pass-through device 100 includes an inner housing 102 and an outer housing 104, such that the inner housing 102 is located on an interior side 106 of an environmental protection suit while the outer housing 104 is disposed on an exterior side 108 of the environmental protection suit. The inner housing 102 includes one or more inner channels 110 which extend from a proximal end 112 to a distal end 114; the proximal end 112 continuing into the raised center portion 113 of the inner housing 102 through which the inner channel opening passes into the interior of the device to connect to channel 116. The distal end 114 extends into the interior side 106 of the environmental protection suit and away from the interior housing 102. The outer housing 104 includes one or more outer channels 116 which extend from a proximal end 118 of the outer channel 116 to a distal end 120 of the outer channel 116, where the proximal end 118 corresponds to the entry point into the raised center portion 117 of outer housing 104 through which the outer channel opening passes into the interior of the device to connect to channel 110. The raised center portions 113 and 117 allow a smooth arc to be formed at the ends of their corresponding channels 110 and 116, respectively, as shown in FIG. 1C, to minimize flow or pressure changes. The distal end 120 extends outward into the exterior side 108 away from the outer housing 104.

The inner housing and outer housing of the pass-through device are integrally molded with the channels and inlet and outlet fittings from flexible PVC (Shore 60-80).

Using techniques that are well known in the art, PVC is made flexible and softer by adding plasticizer to the PVC resin during the molding process to improve its molecular mobility. Examples of common plasticizers include dioctyl phthalate (DOP), di-iso-octyl phthalates (DIOP) and dialphanyl phthalate (DAP), however other plasticizers are known, and combinations of different plasticizers may be used. In general, the more plasticizer that is used the more flexible the resulting PVC will be. The pass-through device according to the present invention is formed using techniques that are well known in the art, such as blow molding, injection molding, extrusion, etc.

Figure 1B:
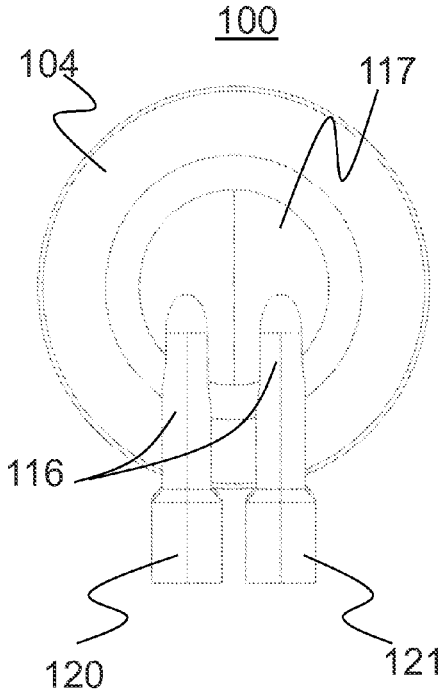
FIG. 1B is a front-view illustration of the pass-through device depicting the outer housing and a plurality of outer channels extending therefrom, according to one embodiment of the invention.
Figure 1C:
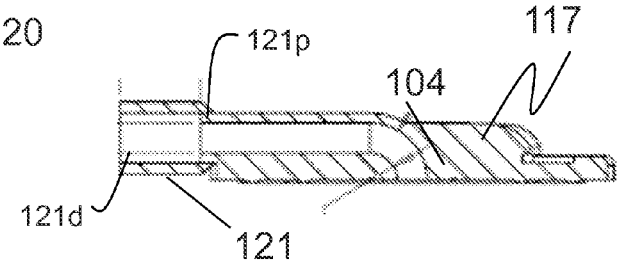
FIG. 1C is a cross-sectional view taken along line C-C of FIG. 1A.

FIG. 1B is a front-view illustration of the pass-through device 100 depicting the outer housing 104 and a plurality of the outer channels 116 extending therefrom, according to one embodiment of the invention. As illustrated, the two channels 116 correspond to the inlet and outlet channels through which fluid is introduced from and returned to the fluid source, respectively. For example, fitting 120 may provide the inflow, and fitting 121 may provide the outflow, or vice versa. Similarly, fittings 115 and 114 (shown in FIG. 2B) may correspond to the inlet and outlet that introduce fluid into and remove fluid from the sealed garment.

Each fitting (inlet and outlet) of the pass-through device comprises a cylindrical tube of flexible PVC extending from and integrally formed with a fluid-conducting channels, the tube having a length, a distal portion with an inner diameter adapted to receive and closely fit a tubing end of a flexible PVC tubing, and a proximal portion with an inner diameter substantially equal to an inner diameter of the flexible PVC tubing.

The junction between the distal inner diameter and the proximal inner diameter defines an insertion stop against which the end of the flexible tubing is pressed to produce a tight fit with uniform flow cross-sections. In one embodiment, the distal inner diameter of the fitting is sized to produce an interference fit with the outer surface of the flexible tubing. The compatibility between the materials of the fitting and the tubing make it possible to solvent bond or ultrasonically weld the components to form a reliable and repeatable liquid tight joint that requires no secondary means of fixation.

FIG. 1C is a cross-sectional view of a fitting 121 for the flow-through device showing the two different inner diameters: a distal portion 121*d* with an inner diameter adapted to receive and closely fit a tubing end of a flexible PVC tubing, and a proximal portion 121*p* with an inner diameter substantially equal to an inner diameter of the flexible PVC tubing. While only fitting 121 of the inner housing is illustrated, it will be readily apparent that the other fittings 114, 115, and 120 will have a similar construction. The matching of the inner diameters of the fittings and tubing eliminate constrictions that create backpressure that can degrade the performance of the LCG. In addition, as stated above, the compatibility between the materials of the fitting and the tubing make it possible to solvent bond or ultrasonically weld the components to form a reliable and repeatable liquid tight joint that requires no secondary means of fixation.

Figure 2A:
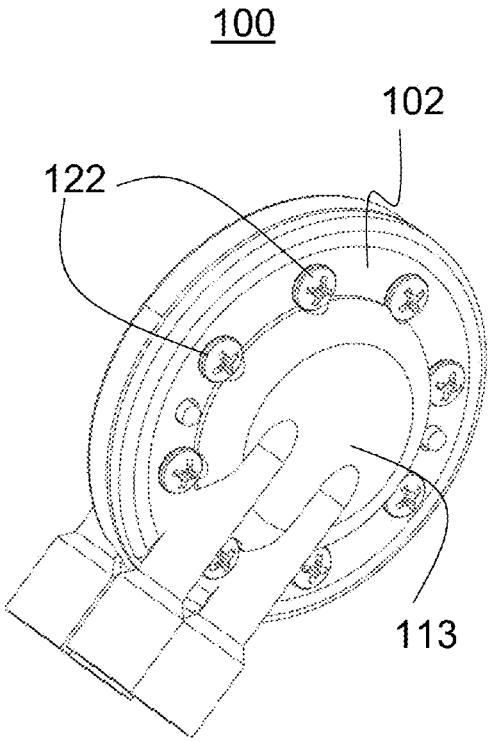
FIG. 2A is a perspective view illustration of the inner housing of the pass-through device depicting a plurality of retention screws disposed on a periphery of the inner housing and the plurality of inner channels and outer channels, according to one embodiment of the invention.

FIG. 2A is a perspective view illustration of the inner housing 102 of the pass-through device 100 depicting one embodiment of the connection means. In this embodiment, the connection means is a plurality of retention screws 122 disposed on a periphery of the inner housing 102. In one embodiment, the retention screws 122 interface with a plurality of barrel nuts (see FIGS. 3A and 3B) disposed on the outer housing 104.

Figure 2B:
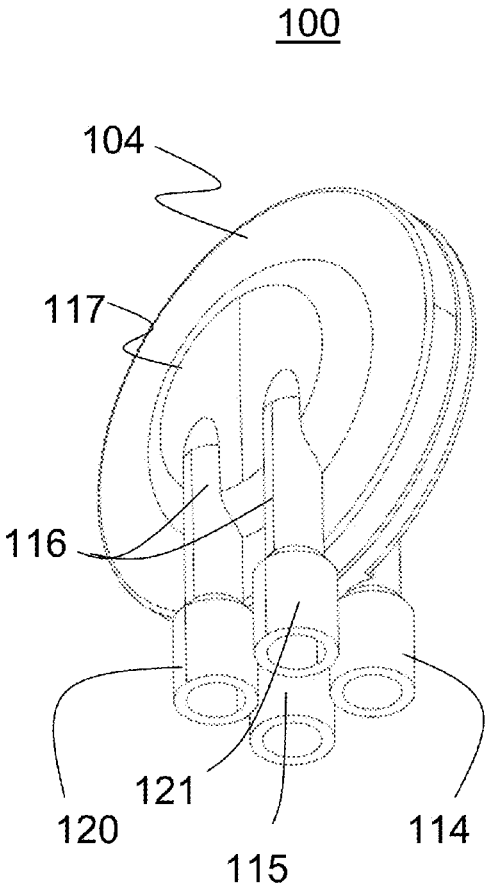
FIG. 2B is a perspective view illustration of the outer housing of the pass-through device depicting the plurality of inner channels and outer channels, according to one embodiment of the invention.

FIG. 2B is a perspective view illustration of the outer housing 104 of the pass-through device 100 depicting an arrangement of the plurality of inner channels 110 and outer channels 116, according to one embodiment of the invention. The inner channels 110 and outer channels 116 may be configured to be coupled with flexible tubing (not shown) which further transports the liquid or gas to or from a particular location outside of the environmental protection suit or to a location within the environmental protection suit.

Figure 3A:
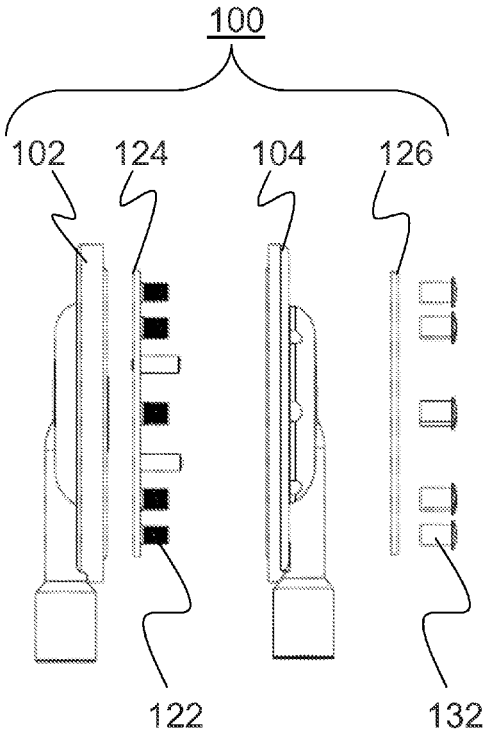
FIGS. 3A and 3B are side and front perspective exploded-view illustrations, respectively, of the pass-through device according to one embodiment of the invention.
Figure 3B:
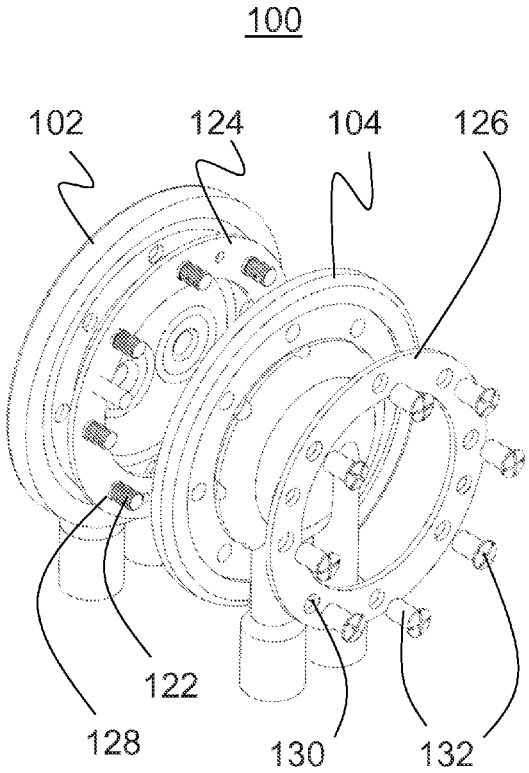

FIGS. 3A and 3B are exploded-view illustrations of the pass-through device 100 depicting an inner flange 124 and outer flange 126, which provide rigid surfaces for attaching and securing the fasteners. The inner flange 124 is disposed between the inner housing 102 and the outer housing 104 and is configured with openings 128 through which the retention screws 122 are fitted. The outer flange 126 is disposed on an external surface of the outer housing 104 and is configured with openings 130 through which a plurality of barrel nuts 132 are fitted. The barrel nuts 132 are designed to receive the retention studs 122 and secure the inner housing 102 with the outer housing 104, as will be described further herein.

Figure 4A:
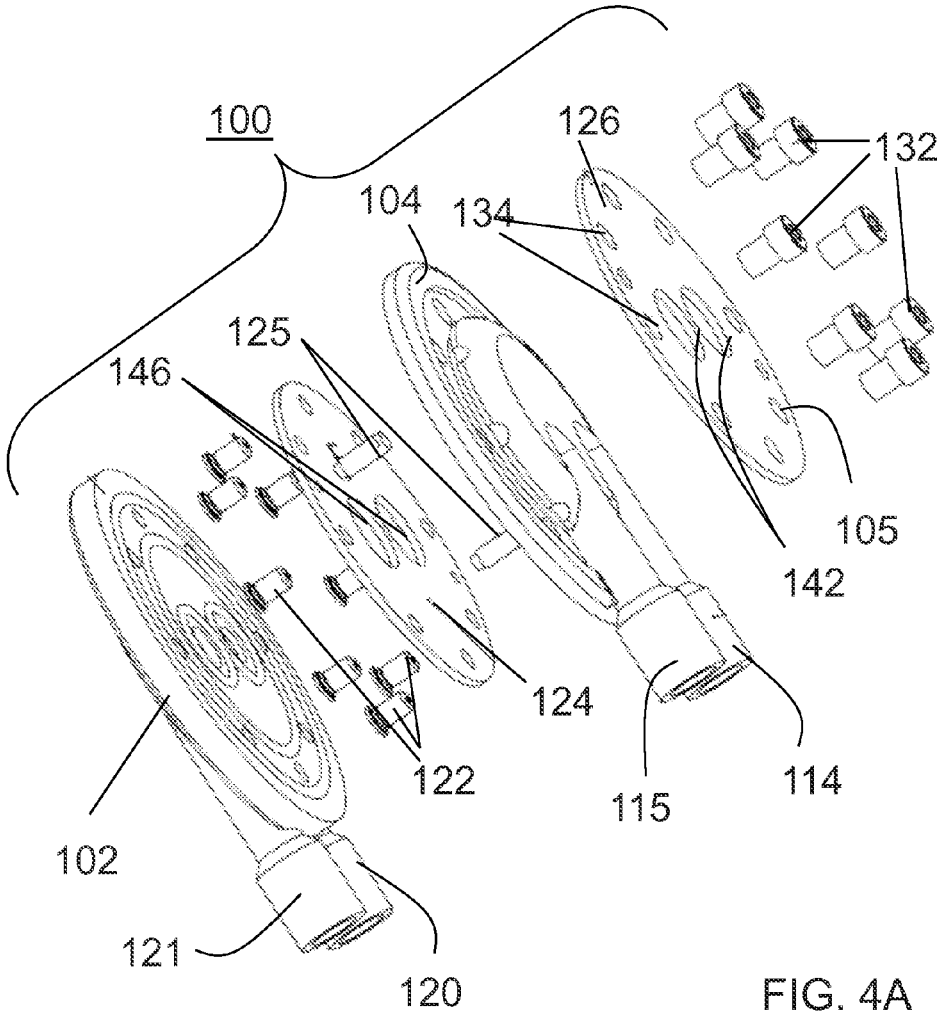
FIG. 4A is an exploded perspective side view of the inventive pass-through device.
Figure 4B:
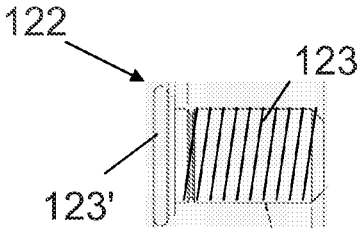
FIG. 4B is a side view of a threaded stud used to fasten the inner and outer housings together.

FIG. 4A is an exploded perspective view of the pass-through device 100 in which the retention studs 122 are shown separated from the inner flange 124. Details of the studs 122, which are commercially sold under the PEM® brand by PennEngineering of Danboro, Pa. as self-clinching threaded studs, are shown in FIG. 4B. Each stud 122 has threaded extensions 123 with an annular base 123' that sits at least partially recessed in the openings 128 of the inner flange 124 (see FIG. 6A). The threaded extensions 123, which extend through openings 128, have a thread pattern and diameter to match the thread patterns of barrel nuts 132. Guide pegs 125 are of a similar construction to the studs 122 except that the shaft extending from the base of the peg is smooth.

Figure 5:
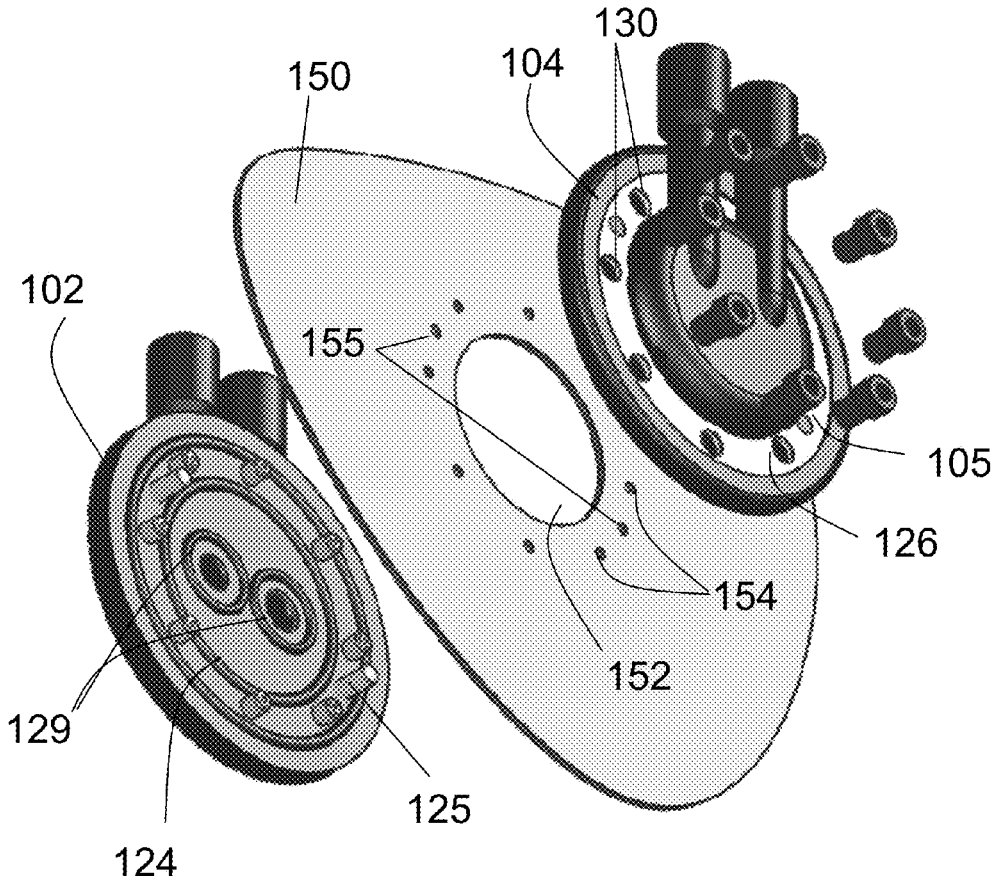
FIG. 5 is an exploded perspective top view of the pass-through-device showing a section of fabric at which the device is attached.

FIG. 5 is an exploded perspective view of the two halves of the pass-through device illustrating the relative placement of the components of the device for attachment to a portion 150 of a protective suit. Opening 152 defines the passage between the interior and exterior of the suit, and will be centered within the device. Openings 154 and 155 are pre-formed through the suit material to match the patterns of the studs 122 and guide pegs 125, so that they can be easily inserted through the material without tearing or otherwise damaging the suit material. After the studs 122 and guide pegs 125 have been inserted through the corresponding openings 154 and 155, openings 105 in the outer housing 104 are first aligned with the guide pegs 125, after which the studs 122 are inserted through the corresponding openings 130. The barrel nuts 132 are aligned with the studs 122 and inserted through openings 130 and then screwed onto studs 122 to secure the pass-through device onto the suit.

Figure 6A:
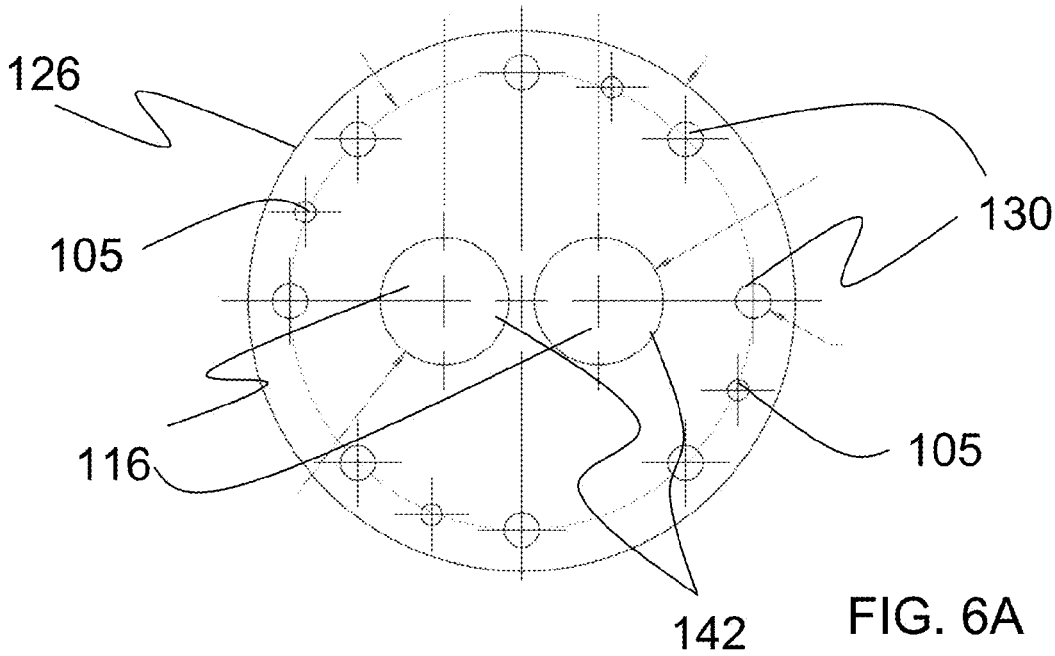
FIG. 6A is a rear view schematic illustration of the inner flange depicting the arrangement and size of the openings for the studs and guide pins, according to one embodiment of the invention.

FIG. 6A is a front view schematic illustration of the outer flange 126 depicting the openings 130 for the plurality of barrel nuts 132 and openings 105 for the guide pegs 125. This arrangement of openings is identical in the outer housing 104. During the molding process for the outer housing 104, the outer flange 126, which is preferably formed from stainless steel, is placed within the mold so that the PVC material forms around the flange, in a process known as "overmolding". This process provides the strength and rigidity of the metal to the housing to firmly retain the fasteners while still retaining the benefits of the flexible material. (It should be noted that FIG. 3B and FIG. 4A show the individual components of the device with the flanges separated from their corresponding housing halves. In reality, the flanges are embedded in the housing halves during the molding process, so they would not actually be seen as separate components during assembly of the device.)

As illustrated, there are eight openings 134 for insertion of the barrel nuts 132 and four openings 105 for receiving the guide pegs 125. As will be readily apparent to those of skill in the art, more or fewer openings may be used for each group of fasteners. FIG. 6A also illustrates the position and size of the flow channels 116 (one inlet/one outlet) and their position relative to the inner channels 110 of inner flange 124. In this embodiment, the outer channels 116 have a diameter of approximately 0.5 inches and are spaced apart from their central radii by about 0.6 inches. One of skill in the art will appreciate that these measurements are merely exemplary and may vary considerably depending on the particular application for the pass-through device as well as the medium which is to be transported through the channels of the pass-through device. These measurements are provided also to demonstrate the small size at which the pass-through device can be manufactured using the flexible PVC.

Figure 6B:
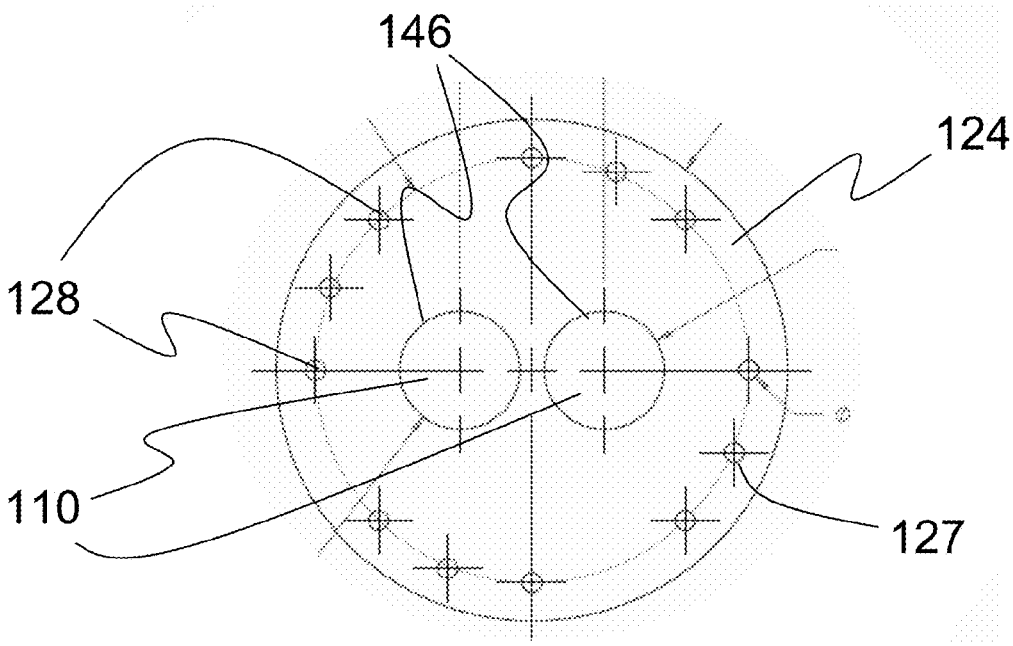
FIG. 6B is a front view schematic illustration the inner flange depicting the arrangement and size of the openings for the studs and pins.

FIG. 6B is a front view schematic illustration of the inner flange 124 depicting the arrangement and size of the openings 128 for receiving the plurality of retention studs 122 and openings 127 for receiving the guide pins 125. FIG. 4B also illustrates the position and size of the inner channels 110 at a point at which they interface with the outer channels 116. In this embodiment, the inner channels 110 have a diameter of approximately 0.5 inches, i.e., identical to the dimensions and spacing of the outer channels 116. As with the outer flange and housing, the inner flange is placed in the mold during formation of the inner housing 102 to embed the stainless steel flange into the flexible PVC of the housing. The studs 122 and guide pins 125 will have been inserted through their corresponding openings in the 128 and 127 prior to placing the inner flange in the mold. In addition to adding rigidity to the inner housing, overmolding of the inner flange into the inner housing covers the bases of the studs and guide pins so that the pass-through device has a smooth surface on the interior of the suit, which increases the user's comfort and prevents any metal edges from catching on the fabric or tubing of the LCG.

Figure 7A:
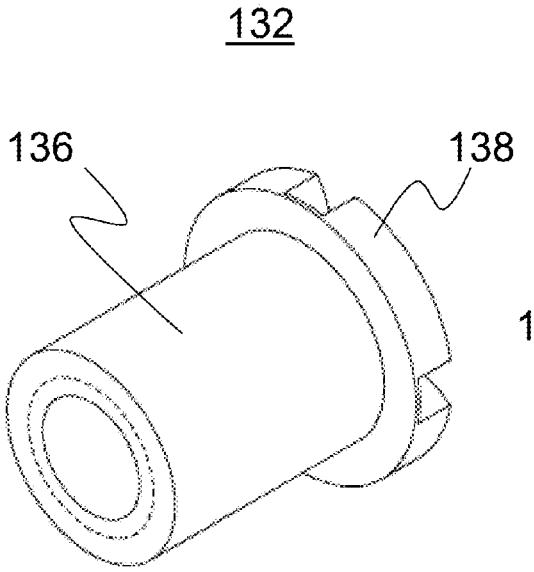
FIGS. 7A-7C are illustrations of the barrel nut, according to one embodiment of the invention, where
Figure 7B:
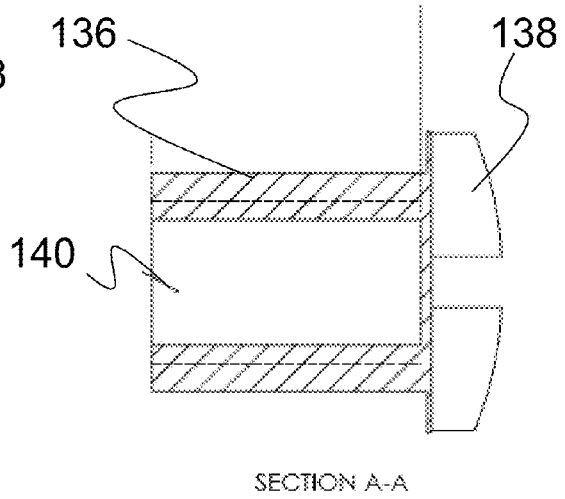
Figure 7C:
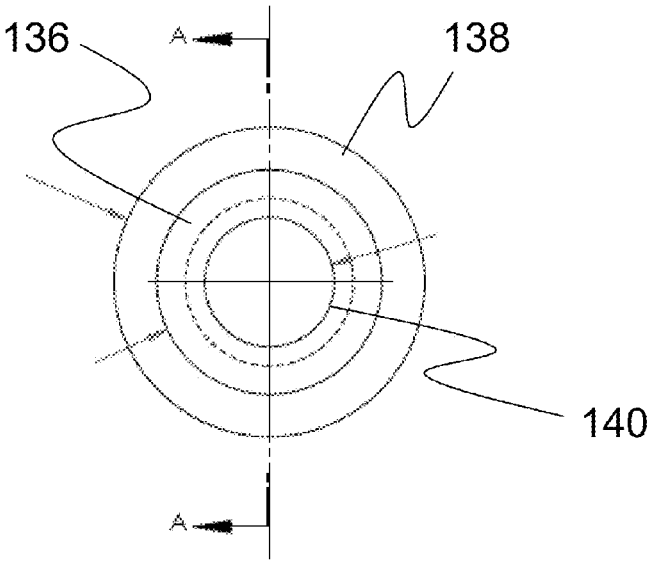

FIGS. 7A-7C are illustrations of the barrel nut 132, according to one embodiment of the invention. As shown in the perspective view illustration in FIG. 7A, the barrel nut 132 includes a hollow cylindrical barrel 136 with a head 138 configured to receive a screwdriver head in order to rotatably tighten the barrel nut 132 around the retention screw 122. The retention screw 122 is threaded into the barrel 136 and can be tightened with a screwdriver using the head (not shown) of the retention screw or the head 138 of the barrel nut 132. FIG. 7B is a side view cut-away illustration taken alone the A-A line shown in FIG. 7C, showing the length of the barrel 136, according to one embodiment of the invention. In the embodiment illustrated herein, the barrel is approximately 0.225 inches long. FIG. 7C shows a top-down view of the barrel nut 132 from the barrel 136 to the head 138, illustrating the diameter of the barrel 136 as contrasted with the diameter of the head 138. In this embodiment, the diameter of the barrel is approximately 0.185 inches, and the diameter of the interior hollow cylinder 140 within the barrel is approximately 0.107 inches. The diameter of the head 138 is approximately 0.255 inches. The above dimensions are provided as examples only. As will be recognized by those skilled in the art, different dimensions are may be used based on the overall dimensions of the pass-through device.

The use of a combination of the barrel nuts 132 and the threaded studs 122 to fasten the inner and outer housings helps to improve the durability and ease of manufacture of the pass-through device. While one option for assembly could be use of a conventional screw that would be inserted from the outer housing into a threaded opening in the inner flange, the inner flange would need to be thick enough to provide sufficient contact surface for securely retaining the screw. Thus, the device would need to be thicker. Further, this approach would require that each opening in the inner flange be threaded, increasing the number of machining steps used in the fabrication process.

In another embodiment, the pass-through device may include paths for electrical or optical wires to provide electricity or data to and from the environmental connection suit. The channels for the electrical wires or optical fibers may be designed and configured similarly to the channels described above for liquids and gases, except that terminal connectors will be required at the point where the inner channel and outer channel connect.

The above description of disclosed embodiments is provided to enable any person skilled in the art to make or use the invention. Various modifications to the embodiments will be readily apparent to those skilled in the art. The generic principals defined herein can be applied to other embodiments without departing from spirit or scope of the invention. Thus, the invention is not intended to be limited to the embodiments shown herein but is to be accorded the widest scope consistent with the principals and novel features disclosed herein.

What is claimed is:

1. A device for conducting a fluid between an interior and an exterior of a sealed fabric enclosure having a pass-through opening, the device comprising:

an inner housing having an inner flange portion, a first inlet channel and a first outlet channel, each of the first inlet and first outlet channels having proximal ends that extend through a center of the inner flange portion;

an outer housing having an outer flange portion with a second inlet channel and a second outlet channel, each of the second inlet and the second outlet channels having proximal ends that extend through a center the outer flange portion, wherein the center of the inner flange portion and the center of the outer flange portion correspond to the pass-through opening of the sealed fabric enclosure;

a plurality of fasteners inserted through matching openings formed in each of the inner flange portion, the outer flange portion and the sealed fabric enclosure to form a sealed connection between the first and second inlet channels and the first and second outlet channels, respectively;

wherein the inner housing and outer housing are made from a flexible polyvinyl chloride (PVC) material; and wherein the inner flange portion comprises a metal plate molded into the flexible PVC material of the inner housing and the outer flange portion comprises a metal plate molded into the flexible PVC material of the outer housing.

2. The device of claim 1, wherein the plurality of fasteners comprises a plurality of barrel nuts, each barrel nut having a barrel portion and a stud portion, and where the barrel portions are embedded into the flexible PVC material of the inner housing during molding.

3. The device of claim 1, wherein the plurality of fasteners are disposed at uniform spacings around the inner and outer flange portions.

4. The device of claim 1, further comprising a plurality of guide pegs extending from the metal plate in the inner housing and a plurality of corresponding openings for receiving the guide pegs in the metal plate in the outer housing.

5. The device of claim 1, wherein each inlet and outlet channel has a fitting disposed at a distal end thereof, the fitting having an inner diameter closely fitting an outer diameter of a tubing adapted to transport the fluid.

6. The device of claim 5, wherein each inlet and outlet channel has an inner diameter matching an inner diameter of the tubing.

7. The device of claim 1, wherein the sealed fabric enclosure is an environmental protection suit.

8. The pass-through device of claim 1, wherein the inlet channels and outlet channels extend from the inner housing and outer housing at approximately right angles.

9. A pass-through device for conducting a fluid between an interior and an exterior of a sealed fabric enclosure having a pass-through opening, the device comprising:

an inner housing formed from flexible PVC and having an inner flange portion comprising a metal plate overmolded into the flexible PVC, a first inlet channel and a first outlet channel, each of the first inlet and first outlet channels having proximal ends that extend through a center of the inner flange portion;

an outer housing formed from flexible PVC and having an outer flange portion comprising a metal plate overmolded into the flexible PVC, a second inlet channel and a second outlet channel, each of the second inlet and the second outlet channels having proximal ends that extend through a center the outer flange portion, wherein the center of the inner flange portion and the center of the outer flange portion correspond to the pass-through opening of the sealed fabric enclosure; and a plurality of fasteners inserted through matching openings uniformly spaced around each of the inner flange portion, the outer flange portion and the sealed fabric enclosure to form a sealed connection between the first and second inlet channels and the first and second outlet channels, respectively.

10. The device of claim 9, wherein the plurality of fasteners comprises a plurality of barrel nuts, each barrel nut having a barrel portion and a stud portion, and where the barrel portions are embedded into the inner housing during molding.

11. The device of claim 9, further comprising a plurality of guide pegs extending from the metal plate in the inner housing and a plurality of corresponding openings for receiving the guide pegs in the metal plate in the outer housing.

12. The device of claim 9, wherein each inlet and outlet channel has a fitting disposed at a distal end thereof, the fitting having an inner diameter closely fitting an outer diameter of a tubing adapted to transport the fluid.

13. The device of claim 12, wherein each inlet and outlet channel has an inner diameter matching an inner diameter of the tubing.

* * * * *